United States Patent [19]

Vignon

[11] 4,187,587

[45] Feb. 12, 1980

[54] TEXTILE MACHINE HAVING HYDRAULICALLY CONTROLLED DRAFTING ROLLERS

[75] Inventor: Louis Vignon, Geneva, Switzerland

[73] Assignee: Heberlein Hispano SA, Vernier-Geneve, Switzerland

[21] Appl. No.: 887,299

[22] Filed: Mar. 16, 1978

[30] Foreign Application Priority Data

Mar. 22, 1977 [CH] Switzerland ..... 3554/77

[51] Int. Cl.[2] ..... D01H 5/52; B30B 15/16

[52] U.S. Cl. ..... 19/272; 100/170

[58] Field of Search ..... 19/272, 267; 100/170

[56] References Cited

U.S. PATENT DOCUMENTS

| | | | |
|---|---|---|---|
| 3,578,766 | 5/1971 | Diolot | 100/170 X |
| 3,884,140 | 5/1975 | Christ et al. | 100/170 X |
| 3,885,465 | 5/1975 | Bergendahl | 100/170 X |

FOREIGN PATENT DOCUMENTS

| | | | |
|---|---|---|---|
| 504458 | 12/1954 | Italy | 19/272 |

*Primary Examiner*—Louis Rimrodt

*Attorney, Agent, or Firm*—Larson, Taylor and Hinds

[57] ABSTRACT

Pressure between rollers in each set thereof in a drawing frame is maintained by oil pressure in a main pipe circuit connected to piston and cylinder assemblies allocated to the sets of rollers. A motor driven pump feeds oil from a tank through a feed pipe to the main circuit except when a first solenoid-controlled valve directs the oil through a first return-flow pipe branched from the feed pipe. So long as a pressure gauge connected to the main circuit is indicating the pressure to be below a minimum, it excites the first solenoid-controlled valve to close the first return-flow pipe. When, as a result of lapping on a drafting roller the gauge indicates a maximum pressure, it causes the machine to stop. A second solenoid-controlled valve has its excitation periodically suppressed to open a passage through a second return-flow pipe to prevent the temperature of the drawing frame from overheating the main pipe circuit.

4 Claims, 2 Drawing Figures

1
2
3
4
5
6
7
8
9
10
11
12
13
14
15
16
17
17'

19
0V
18
14'
15'
21
20
+

TEXTILE MACHINE HAVING HYDRAULICALLY CONTROLLED DRAFTING ROLLERS

FIELD OF THE INVENTION

The invention relates to textile machines having hydraulic pressing devices for drafting zones, especially drawing frames.

DESCRIPTION OF THE PRIOR ART

The use of hydraulic pressing devices for drafting zones on drawing frames is already known. These pressing devices comprise a manually operated pump, a pressure gauge for control purposes having two calibration marks indicating minimum and maximum pressure respectively, and if necessary, a safety valve. Nevertheless, pressing devices of this type have three main disadvantages. Firstly the build-up of pressure is time-consuming, requiring a considerable amount of physical strength. Secondly, not even the smallest leak can be allowed, since the pressure drops to a minimum and the frame stops or does not operate satisfactorily until the leak has been localized and repaired. Thirdly, even if there is no disturbance, when the frame stops the hydraulic oil is cold and becomes increasingly hotter as the frame heats up, the pressure rising proportionally towards a calibration mark on the pressure gauge denoting maximum pressure.

SUMMARY OF THE INVENTION

The object of the invention is to remove the shortcomings of the known devices and to create a pressing device permitting the pressure to be built up rapidly by simple means and the normal pressure to be restored automatically, should the pressure be inadequate.

The problem is solved in this invention by a pressing device having hydraulic cylinders assigned to the various drafting rollers and connected to a main hydraulic pipe circuit and a pressure gauge for control purposes, a motor-operated pump for supplying oil from a supply tank to the main circuit through a feed pipe, a return-flow pipe to the supply tank, which is a branch of the feed pipe, a first solenoid-controlled valve having alternative open and closed conditions and arranged to direct the flow of oil to the main circuit when in one of said conditions and to the return-flow pipe when in the other of the said conditions and a second return-flow pipe to the supply tank, which is a branch of the main circuit, being opened and closed by a second solenoid controlled valve.

DESCRIPTION OF THE DRAWINGS

A practical example of the invention will now be described with reference to the accompanying drawings, in which.

Figures 1, 2:
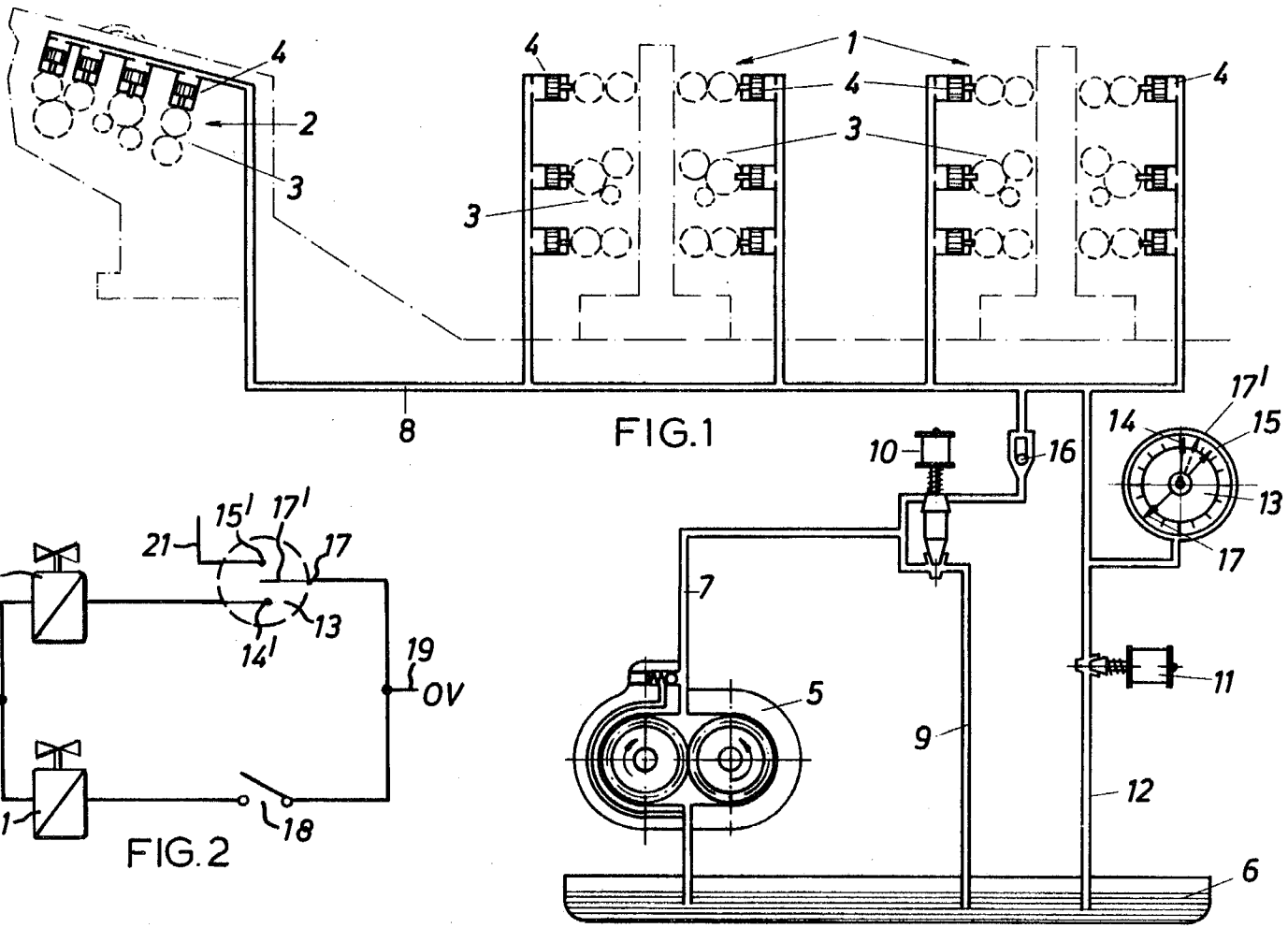
FIG. 1 is a purely schematic representation of a drawing frame with a hydraulic press device.
FIG. 2 is a circuit diagram.

The drawing frame shown in FIG. 1 is provided with two drafting zones, the first zone comprising a series of drafting zones 1 and the second zone a drafting zone 2. Pressure is applied by pistons in hydraulic cylinders 4 respectively to drafting rollers 3 of the sets thereof in the various drafting zones. A motor-operated pump 5 pumps oil from a supply tank 6, directing it towards a main pipe circuit 8 through a feed pipe 7. The main circuit 8 is connected to the cylinders 4 of the drafting zones 1 and 2. A valve controlled by a solenoid 10 directs the flow of oil either to the main circuit 8 or to a return-flow pipe 9 leading into the supply tank 6. Furthermore, a second valve controlled by a solenoid 11, so long as this valve is closed, maintains the pressure in the main circuit 8. When the second solenoid controlled valve 11 is opened, some of the oil in the circuit 8 can return to the supply tank 6 through the feed pipe 12, thereby reducing the pressure in the circuit 8. The second valve is closed by excitation of the solenoid 11.

A pressure gauge 13 connected between the circuit 8 and the solenoid controlled valve 11 is provided with two calibration marks 14 (for minimum pressure) and 15 (for maximum pressure) and is used for control purposes. A back-pressure valve 16 stops the oil returning through the pipe 9 to the pump 5 from the main circuit 8.

Referring to the circuit diagram of FIG. 2, it will be seen that the solenoid valves 10 and 11 comprise relays in parallel circuits between supply lines 19 and 20. The circuit for the solenoid valve 11 is controlled by a switch 18 that is automatically closed by starting the motor-operated pump 5. The contact arm 17 moves until it reaches a contact 14' corresponding to the calibration mark 14. The solenoid controlled valve 10 is thereby opened to allow oil to return through the feed pipe 9. When the contact arm 17 reaches a contact 15' associated with the calibration mark 15, it completes a circuit through a conductor 21 connected to means for stopping the drawing frame.

The device shown in the drawings, operates as follows:

As soon as the motor-operated pump 5 has started and the solenoid valves 10 and 11 have been excited to stop the return of oil through the pipes 9 and 12 to the tank 6, oil is pumped under pressure into the main circuit 8 until the pointer 17 of the pressure gauge 13 reaches the calibration mark 14, at which point the electric circuit through the contact 14' which is controlled by the pressure gauge 13, is closed, cutting the excitation of the solenoid valve 10 and returning the oil supplied by the motor-operated pump 5 to the supply tank 6 through the feed pipe 9. The pressure in the main circuit 8 is now normalized, the pointer 17 assuming a position such as 17' between the minimum and maximum pressure markings 14 and 15. Should the pressure in the main circuit 8 drop for one reason or another, the solenoid valve 10 is re-excited as soon as the pointer 17 of the pressure gauge 13 passes the calibration mark 14 until the pressure has been normalized again without the drawing frame being stopped.

In order to prevent the temperature of the drawing frame from exerting too great an effect on the oil pressure, the pressure in the main circuit 8 can be reduced for short periods of time by suppressing the excitation of the solenoid valve 11. The pressure is therefore returned to the desired reading, this operation being performed when the cans are changed on the frame.

In order to reduce the pressure in the main circuit 8 completely, it suffices to stop the motor-operated pump 5 and to cut the power supply to the solenoid valve 11, the oil returning to the supply tank 6 through the feed pipe 12.

Lapping on one of the drafting rollers 3 causes the piston of the associated one of the hydraulic cylinders 4 to be displaced and the pressure to rise in the main circuit 8. As soon as the pointer 17 of the pressure gauge 13 reaches the calibration mark 15, the drawing frame is instantly stopped.

The device which is the object of this invention, has a number of advantages: it permits simple and rapid pressure build-up, temporary pressure changes and rapid pressure reduction. Insufficient pressure is immediately detected and compensated without stopping the textile machine. Too high a pressure, for example lapping on drafting rollers, is immediately detected and the drawing frame is instantly stopped.

I claim:

1. A textile machine comprising a plurality of sets of drafting rollers, hydraulic piston and cylinder assemblies respectively allocated to said sets of drafting rollers for maintaining pressure between the rollers in each set thereof by introduction of hydraulic pressure into the cylinders of said piston and cylinder assemblies, a main pipe circuit interconnecting all said cylinders, a tank for containing oil, a motor-operated pump connected to withdraw oil from said tank, a pipe system comprising both a feed pipe, interconnecting said pump and said main pipe circuit, and a first return-flow pipe branched from said feed pipe and leading to said tank for the return of oil thereinto, a first solenoid-controlled valve having alternative open and closed conditions and mounted in said pipe system for directing oil into said pipe circuit when in one of said open and closed conditions and through said first return-flow pipe when in the other of said open and closed conditions, a second return-flow pipe leading from said main pipe circuit to said tank, a second solenoid-controlled valve in said second return-flow pipe for controlling the flow of oil through said second return-flow pipe, and a pressure gauge connected to said main pipe circuit and operatively connected to control said first solenoid-controlled valve in response to hydraulic pressure in said main pipe circuit.

2. A textile machine according to claim 1, in which said pressure gauge is operative to energize said first solenoid-control valve only when the hydraulic pressure in said main pipe drops below a predetermined minimum value.

3. A textile machine according to claim 1, comprising means controlled by said pressure gauge for stopping the machine when the hydraulic pressure in said main pipe circuit rises above a predetermined maximum value.

4. A textile machine according to claim 1, in which a back-pressure valve for stopping return flow is mounted in said feed pipe between said main circuit and said first solenoid-controlled valve.

* * * * *